US008801413B2

(12) United States Patent
Matsubara

(10) Patent No.: US 8,801,413 B2
(45) Date of Patent: Aug. 12, 2014

(54) HELICAL GEAR PUMP

(75) Inventor: Masami Matsubara, Fuji (JP)

(73) Assignee: JATCO Ltd, Fuji-shi (JP)

( * ) Notice: Subject to any disclaimer, the term of this patent is extended or adjusted under 35 U.S.C. 154(b) by 231 days.

(21) Appl. No.: 13/510,097

(22) PCT Filed: Nov. 4, 2010

(86) PCT No.: PCT/JP2010/069578

§ 371 (c)(1),
(2), (4) Date: May 16, 2012

(87) PCT Pub. No.: WO2011/062063

PCT Pub. Date: May 26, 2011

(65) Prior Publication Data

US 2012/0230856 A1 Sep. 13, 2012

(30) Foreign Application Priority Data

Nov. 20, 2009 (JP) ..... 2009-264714
Jan. 29, 2010 (JP) ..... 2010-017931

(51) Int. Cl.
*F01C 1/16* (2006.01)
*F03C 2/00* (2006.01)
*F03C 4/00* (2006.01)

(52) U.S. Cl.
USPC ..... 418/201.1; 418/9; 418/182; 418/202

(58) Field of Classification Search
CPC ..... F04C 2/16; F04C 2/18; F04C 18/16; F04C 15/0042; F04C 15/062; F04C 23/001; F04C 224/50; F04C 2240/52; F04C 2240/30; F04C 2240/60; F01C 1/16
USPC ..... 418/9, 201.1–201.3, 202, 220, 180, 182
See application file for complete search history.

(56) References Cited

U.S. PATENT DOCUMENTS

| | | | | |
|---|---|---|---|---|
| 2,382,042 | A | 8/1945 | Entyre | |
| 3,796,526 | A * | 3/1974 | Cawley | 418/201.1 |
| 3,910,731 | A * | 10/1975 | Persson et al. | 418/9 |
| 2009/0232691 | A1 * | 9/2009 | Van Leuven | 418/201.1 |

FOREIGN PATENT DOCUMENTS

| | | | | |
|---|---|---|---|---|
| FR | 2 524 575 | A1 | 10/1983 | |
| GB | 751484 | A | 6/1956 | |
| GB | 1218130 | A | 1/1971 | |
| GB | 1499484 | A | 2/1978 | |
| JP | 31-14962 | Y1 | 9/1956 | |
| JP | 47-16424 | Y1 | 6/1972 | |
| JP | 58-074885 | A | 5/1983 | |
| JP | 2005220872 | A * | 8/2005 | F04C 2/08 |
| WO | WO 2008/029477 | A1 | 3/2008 | |

* cited by examiner

*Primary Examiner* — Theresa Trieu
(74) *Attorney, Agent, or Firm* — Foley & Lardner LLP

(57) ABSTRACT

A helical gear pump includes a second helical gear provided coaxially with a drive helical gear, a third helical gear engaged with the second helical gear and provided on a third shaft different from a shaft of the drive helical gear and a shaft of a driven helical gear, and a bearing for supporting the third shaft and receiving a thrust force.

5 Claims, 2 Drawing Sheets

HELICAL GEAR PUMP

TECHNICAL FIELD

This invention relates to a gear pump using a helical gear.

BACKGROUND TECHNOLOGY

Gear pumps are pumps with lower cost and less friction as compared with vane pumps and widely used as oil pumps and the like, for example, by being installed in automotive vehicles.

A gear pump generally uses a spur gear to avoid the generation of a thrust force.

Since gear pumps using a spur gear cause high pump noise due to an insufficient contact ratio of gears, it is not for an application required to be quiet (e.g. HEV, EV, etc.). Thus, it has been obliged to use more expensive vane pumps and the like, which has led to a cost increase.

On the other hand, gear pumps using a helical gear have an advantage of improving quietness while maintaining the same pump performance as compared with those using a spur gear.

However, a helical gear generates a thrust force in an axial direction and increases a frictional force between the gear and a pump body, wherefore there is a possibility of problems such as a leakage increase and seizure caused by friction.

As a measure against this thrust force, there are known a method for cancelling a thrust force by applying a discharge pressure to a gear end surface and a so-called two-set gear type pump in which gears are so coaxially arranged that twist directions thereof are opposite and respectively used as a pump.

Further, a gear pump which cancels a thrust force by using a double helical gear (JP1983-74885A) is also known.

SUMMARY OF INVENTION

The method for cancelling a thrust force by a discharge pressure can be realized at relatively low cost without being associated with a large structural change, but is not compatible with such an application in which the rotational speed and the discharge amount change, since a force to be canceled varies.

Further, in the two-set type gear pump, a thrust force can be canceled, but the number of parts increases to increase cost and weight, wherefore its application is restricted. Particularly, in the case of installation in an automotive vehicle, there is a large weight restriction and it is difficult to adopt.

A thrust force can be canceled by adopting the double helical gear, but gear processing is highly difficult and high-precision processing not only increases cost, but also is not suitable for mass production. Further, a leakage amount increases depending on processing precision and it is not possible to adopt in a high-pressure discharge application.

This invention was developed in view of such problems and aims to enable a measure against a thrust force to be taken in a gear pump adopting a helical gear and provide a helical gear pump which does not increase processing/production cost.

According to an aspect of this invention is directed to a helical gear pump in which a drive helical gear and a driven helical gear are provided in a pump body forming a pump chamber, comprising a second helical gear which coaxially rotates with the drive helical gear; a third helical gear which is engaged with the second helical gear and provided on a third shaft different from a shaft of the drive helical gear and a shaft of the driven helical gear; and a bearing which supports the third shaft and receives a thrust force.

According to the aspect of this invention, the second helical gear and the third helical gear for canceling thrust forces generated by the drive helical gear and the driven helical gear are provided and these forces are received by the bearing. Thus, thrust forces of a gear pump composed of helical gears can be canceled.

Further, since no particular anti-leakage measure needs to be taken and high-precision processing and expensive parts are not necessary for these second helical gear, third helical gear and bearing, production cost can be suppressed.

Embodiments of this invention and advantages thereof are described in detail below with reference to the accompanying drawings.

DESCRIPTION OF EMBODIMENTS

A helical gear pump according to an embodiment of this invention will be described below with reference to the figures.

Figure 1:
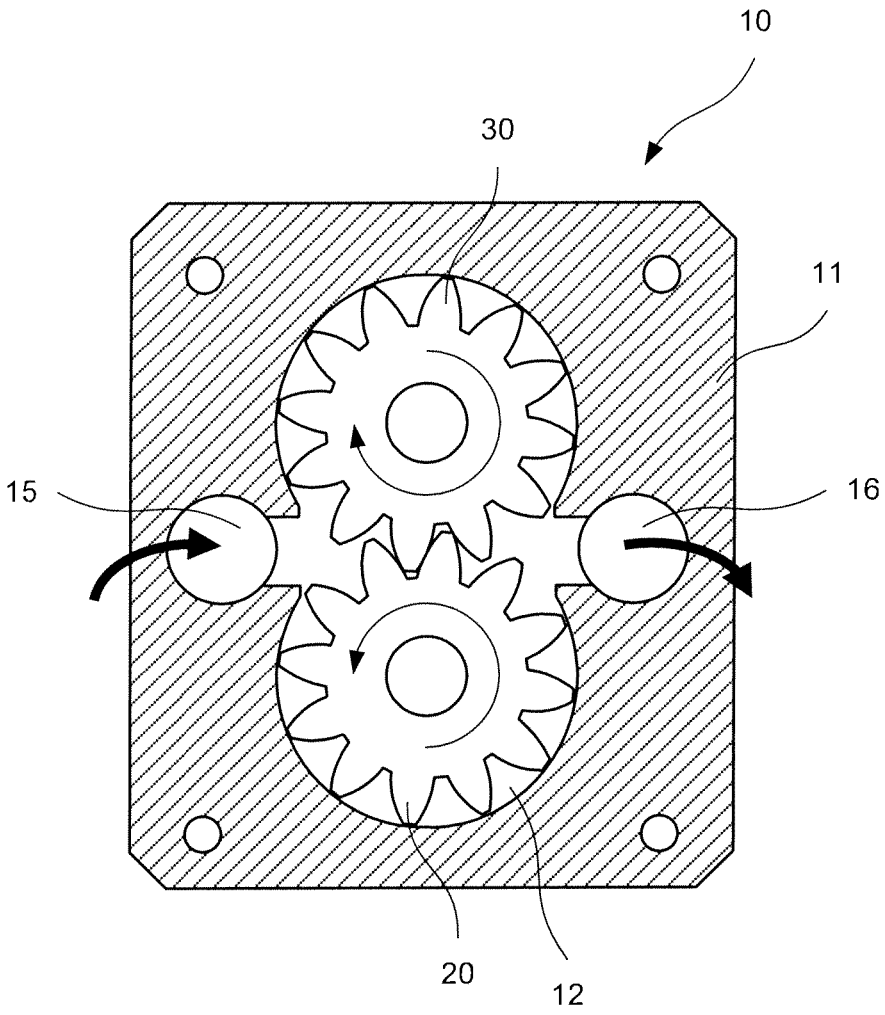
FIG. 1 is a vertical sectional view of a helical gear pump according to an embodiment of this invention.
Figure 2:
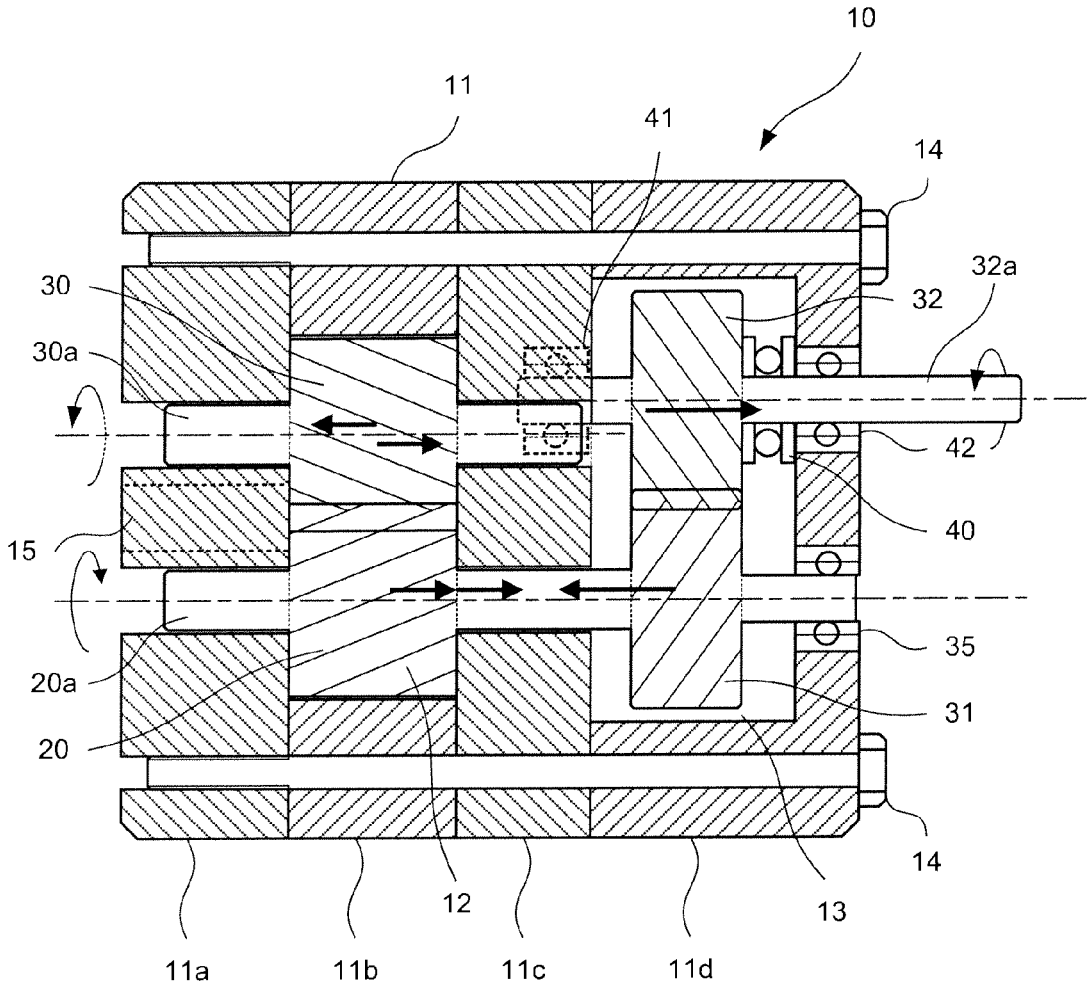
FIG. 2 is a horizontal sectional view of the helical gear pump according to the embodiment of this invention.

FIG. 1 is a vertical sectional view of a helical gear pump 10 according to the embodiment of this invention, and FIG. 2 is a horizontal sectional view of the helical gear pump 10 according to the embodiment of this invention.

As shown in FIG. 1, the helical gear pump 10 includes a pump body 11, a drive side gear 20 and a driven side gear 30 as main component parts.

The drive side gear 20 is driven by a drive source (not shown) and rotates to rotate the driven side gear 30 while being engaged with the driven side gear 30. These drive side gear 20 and driven side gear 30 are helical gears.

The pump body 11 is internally formed with a pump chamber 12 in which the drive side gear 20 and the driven side gear 30 are housed and a fluid is moved. The pump body 11 also includes an inflow port 15 through which the fluid is introduced into the pump chamber 12, and a discharge port 16 through which the inflow fluid is discharged.

The fluid having flowed into the helical gear pump 10 through the inflow port 15 is moved while being trapped in a space between the tooth surface of the drive side gear 20 or the driven side gear 30 and the pump body 11, and fed to the discharge port 16.

The helical gear pump 10 is constructed by such a mechanism.

Helical gears have an advantage of having excellent quietness as compared with spur gears but, on the other hand, have a problem of generating a thrust force (force in an axial direction).

In the helical gear pump 10 using the helical gears, thrust forces are known to be generated as follows.

Since a thrust force due to a driven torque from the drive side gear 20 and a thrust force generated from a drive force of itself for discharging the fluid are equal and act in opposite directions at the driven side gear 30, the thrust forces are canceled.

On the other hand since a thrust force due to a driven-gear drive torque for driving the driven side gear 30 and a thrust force generated from a drive force of itself for discharging the fluid act in the same direction at the drive side gear 20, a two-fold force acts.

Further, in the pump for discharging the fluid, it is necessary to suppress a leakage amount to improve discharge efficiency and contact surfaces of gear end surfaces and the pump body 11 and sliding parts of bearing parts are held in direct contact with a gap, for example, in the order of several to several tens of μm.

Thus, if friction on the contact surfaces increases due to an increase of the thrust force, problems such as an increase of leakage and seizure caused by abrasion may occur.

If the gears, the interior of the pump chamber and the bearing parts are processed with high precision or a coating member, packing or the like with low friction is used as a measure against this friction, cost increases.

Accordingly, in the embodiment of this invention, the following configuration is adopted to cope with thrust forces generated by the helical gears in a part other than the pump chamber 12.

As shown in FIG. 2, the helical gear pump 10 includes a gear chamber 13, which is a space different from the pump chamber 12, outside the pump chamber 12, and a pair of helical gears (drive side second gear 31, third gear 32) are arranged therein.

Specifically, a shaft 20*a* of the drive side gear 20 is extended toward the drive source, the drive side second gear 31 is provided coaxially with this shaft 20*a*, and the third gear 32 engaged with this drive side second gear 31 is provided. The drive side second gear 31 and the third gear 32 are helical gears.

The third gear 32 is coupled to a third shaft 32*a* different from the shaft 20*a* of the drive side gear 20 and a shaft 30*a* of the driven side gear 30.

The third shaft 32*a* is driven by a drive source (not shown) connected, for example, via a sprocket, a chain or the like. The third shaft 32*a* is driven in a counterclockwise direction toward an end surface side of a second cover 11*d* of the helical gear pump 10.

The pump body 11 includes a first body 11*b* provided with the pump chamber 12 and a second body 11*c* forming one wall of the pump chamber 12 and partitioning between the pump chamber 12 and the gear chamber 13.

The pump body 11 includes a first cover 11*a* provided with the inflow port 15 and the discharge port 16 and the second cover 11*d* forming the gear chamber 13 and provided with a bearing 40 to be described later.

The first body 11*b* and the second body 11*c* are tightly held by the first cover 11*a* and the second cover 11*d* from opposite sides. These are fastened together by a plurality of bolts 14.

The shaft 20*a* of the drive side gear 20 and the drive side second gear 31 is supported by a bearing 35, which is a ball bearing, on the second cover 11*d*.

The third shaft 32*a* provided with the third gear 32 is supported by the bearing 40, which is a ball bearing, on the second cover 11*d*. The third shaft 32*a* penetrates through the second cover 11*d* to be connected to the drive source (not shown).

The third gear 32*a* is supported by a bearing 41, which is a ball bearing, on the second body 11*c* and supported by a bearing 42, which is a ball bearing, on the second cover 11*d*.

As described above, a large thrust force acts on the drive side gear 20 on a pump driving side. This thrust force is transmitted to the drive side second gear 31 by the shaft 20*a*.

Design parameters of the drive side second gear 31 and third gear 32 are set as follows.

A helix angle at a base circle is twice as large as helix angles of the drive side gear 20 and the driven side gear 30 on base circles.

The gears 31, 32 are engaged in the same helix directions as the helix directions of the drive side gear 20 and the driven side gear 30.

In this way, the two-fold force on the shaft 20*a* is canceled by the drive side second gear 31 and third gear32.

More specifically, the drive side gear 20 causes a two-fold thrust force to act on the shaft 20*a* from left to right in FIG. 2. On the other hand, since the drive side second gear 31 having a helix angle twice as large as that of the drive side gear 20 at the base circle is driven by the third gear 32, a two-fold thrust force acts on the shaft 20*a* from right to left in FIG. 2. By such actions, the thrust forces on the shaft 20*a* are canceled out.

The third gear 32 that drives the drive side second gear 31 causes a two-fold thrust force to act toward the drive source (from left to right in FIG. 2) on the third shaft 32*a*. The third shaft 32*a* is supported by the bearing 40 and all the two-fold thrust force is received by the bearing 40.

By such a configuration, thrust forces generated on the helical gears (drive side gear 20, driven side gear 30) for discharging the fluid can be canceled by the helical gears (drive side second gear 31, third gear 32) provided outside the pump chamber.

The design parameters of the drive side second gear 31 and third gear 32 are not necessarily fixed to these values. Actual thrust forces of the helical gear pump 10 may be measured and a fine adjustment may be made based on a measurement result. In this way, thrust forces can be more accurately coped with.

As described above, in the helical gear pump 10 of the embodiment of this invention, the helical gears (drive side second gear 31, third gear 32) for cancelling thrust forces are provided in addition to the helical gears (drive side gear 20, driven side gear 30) forming the pump.

Since the thrust forces generated on the drive side gear 20 and the driven side gear 30, which are helical gears, at the time of discharging the fluid are canceled by such a configuration, a gear pump with high quietness becomes practicable.

Since the drive side second gear 31 and third gear 32 for canceling thrust forces are provided in the gear chamber 13 different from the pump chamber 12, no anti-leakage measure needs to be taken and high-precision processing, packing or the like is not necessary, wherefore production cost can be suppressed.

Since the bearing 40 for receiving all the thrust force is also provided in the gear chamber 13 different from the pump chamber 12, no anti-leakage measure is necessary therefore. Thus, a versatile part such as a ball bearing with high strength can be used without using a special material and production cost can be suppressed.

The bearing 40 is not necessarily a ball bearing and may be another type of bearing such as a needle bearing.

Without being limited to the embodiment described above, various modifications and changes can be made within the scope of the technical concept thereof and it is apparent that they are also included in the technical scope of this invention.

The present application claims a priority based on Japanese Patent Application No. 2009-264714 and Japanese Patent Application No. 2010-17931 filed with the Japan Patent Office on Nov. 20, 2009 and Jan. 29, 2010 respectively, all the contents of which are hereby incorporated by reference.

The invention claimed is:

1. A helical gear pump in which a drive helical gear and a driven helical gear are provided in a pump body forming a pump chamber, comprising:

a second helical gear which coaxially rotates with the drive helical gear;

a third helical gear which is engaged with the second helical gear and provided on a third shaft different from a shaft of the drive helical gear and a shaft of the driven helical gear; and a bearing which supports the third shaft and receives a thrust force.

2. The helical gear pump according to claim 1, wherein:

design parameters of the second helical gear and the third helical gear with respect to those of the drive helical gear and the driven helical gear are that a helix angle at a base circle is twice as large and a helix direction is same.

3. The helical gear pump according to claim 1, wherein:

the second helical gear, the third helical gear and the bearing are provided in a gear chamber formed outside the pump chamber.

4. The helical gear pump according to claim 1, wherein:

the drive helical gear is driven by driving the third shaft.

5. The helical gear pump according to claim 1, wherein:

the pump body includes a first body, a second body, and a first cover and a second cover for tightly holding the first body and the second body from opposite sides;

the first body tightly held by the first cover and the second body includes the pump chamber;

a space formed between the second body and the second cover forms the gear chamber; and the bearing is provided on the second cover.

* * * * *